US009207643B2

(12) United States Patent
Karapatis et al.

(10) Patent No.: US 9,207,643 B2
(45) Date of Patent: Dec. 8, 2015

(54) STRIKING MECHANISM PROVIDED WITH A MEANS OF SELECTING THE MODE OF VIBRATION OF A GONG

(71) Applicant: Montres Breguet S.A., L'Abbaye (CH)

(72) Inventors: Polychronis Nakis Karapatis, Premier (CH); Jerome Favre, Neuchatel (CH); Davide Sarchi, Renens (CH); Younes Kadmiri, Morre (FR); Fabio Sciascia, Valeyres-sous-Ursins (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/276,039

(22) Filed: May 13, 2014

(65) Prior Publication Data

US 2014/0355398 A1 Dec. 4, 2014

(30) Foreign Application Priority Data

May 28, 2013 (EP) ..... 13169516

(51) Int. Cl.

| | |
|---|---|
| ***G04B 21/06*** | (2006.01) |
| ***G04B 23/02*** | (2006.01) |
| ***G04B 21/08*** | (2006.01) |
| *G04B 21/02* | (2006.01) |
| *G04B 23/00* | (2006.01) |
| *G04B 21/00* | (2006.01) |

(52) U.S. Cl.

CPC ..... *G04B 23/026* (2013.01); *G04B 21/06* (2013.01); *G04B 21/08* (2013.01); *G04B 23/028* (2013.01); *G04B 21/00* (2013.01); *G04B 21/02* (2013.01); *G04B 23/00* (2013.01)

(58) Field of Classification Search

CPC ..... G04B 21/00; G04B 21/02; G04B 21/026; G04B 21/06; G04B 21/08; G04B 23/026; G04B 23/028; G04B 23/10; G04B 23/02

See application file for complete search history.

(56) References Cited

U.S. PATENT DOCUMENTS

| | | | | |
|---|---|---|---|---|
| 2007/0140067 | A1* | 6/2007 | Greubel et al. | 368/260 |
| 2008/0074956 | A1 | 3/2008 | Karapatis | |
| 2008/0192585 | A1* | 8/2008 | Corthesy et al. | 368/268 |
| 2008/0273426 | A1* | 11/2008 | Corthesy et al. | 368/262 |
| 2009/0278670 | A1* | 11/2009 | Karapatis et al. | 340/393.4 |

(Continued)

FOREIGN PATENT DOCUMENTS

| | | | |
|---|---|---|---|
| EP | 1 906 267 | A1 | 4/2008 |
| EP | 2 463 732 | A1 | 6/2012 |

OTHER PUBLICATIONS

European Search Report issued Dec. 11, 2013, in Patent Application No. EP 13 16 9516, filed May 28, 2013 (with English-language translation).

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

A striking mechanism, particularly for a watch, includes at least one gong fixed to a gong-carrier, at least one hammer for striking the gong at predetermined times, and a device to select at least one mode of vibration of the gong. The selection device includes at least one selector element arranged in contact on a part of the gong and held on a vibration node of a mode of vibration of the gong to be selected so as to block other modes of vibration. The selector element can be moved on the gong by a mechanical or magnetic movement device.

16 Claims, 3 Drawing Sheets

(56) References Cited

U.S. PATENT DOCUMENTS

2011/0051567 A1* 3/2011 Karapatis et al. ..... 368/273
2011/0158058 A1* 6/2011 Marechal et al. ..... 368/243
2012/0063275 A1* 3/2012 Favre et al. ..... 368/243
2012/0140603 A1* 6/2012 Sarchi et al. ..... 368/272
2012/0147715 A1 6/2012 Karapatis et al.

* cited by examiner

STRIKING MECHANISM PROVIDED WITH A MEANS OF SELECTING THE MODE OF VIBRATION OF A GONG

The application claims priority from European patent application No. 13169516.5 filed May 28, 2013, the entire disclosure of which is hereby incorporated herein by reference.

FIELD OF THE INVENTION

The invention concerns a striking mechanism, which is provided with a means of selecting at least one mode of vibration of a gong or of several gongs. The striking mechanism, particularly for a watch, further includes at least one gong, secured to a gong-carrier, and at least one hammer for striking the gong at predetermined times.

BACKGROUND OF THE INVENTION

Within the field of watch-making, a conventional architecture is used to make movements, which are provided with striking mechanisms, such as minute repeaters. For an embodiment of this type, the gong used is a metal wire, which may be of circular or rectilinear shape. This circular metal wire may be arranged around the movement, inside the watch frame. The gong is fixed to at least one gong-carrier, which is in turn secured to a watch plate. The gong vibration is generated by the impact, generally in proximity to the gong-carrier, of at least one hammer. This vibration is made up of several natural frequencies, the number and intensity of which, in particular in the audible domain, depend on the geometry of the gong, the securing or support conditions of the gong, shock conditions and the physical properties of the material. The vibration of the gong is also transmitted to downstream elements in the watch case via the gong-carrier, and radiated in the air.

When the striking mechanism hammer strikes the gong or gongs in a striking mode, the gong starts to vibrate with superposition of all its natural modes of vibration. The gong can thus vibrate with various modes of vibration in the audible frequency range of 100 Hz to 20 kHz. For a gold or steel gong for example having a diameter of 0.6 mm and a length close to 90 mm, a first natural mode of vibration is generally close to 100 Hz, and the density of the modes of vibration may be up to 3 $kHz^{-1}$ particularly within the frequency range of 3 kHz to 10 kHz. The first modes of vibration below 1 kHz generally cannot be efficiently radiated by the watch elements. The actuation thereof thus represents a loss of acoustic energy, which is a drawback. Moreover, too great a spectral density can create a sound that is much too rich, which may thus become cacophonous, which is also a drawback of conventional striking mechanisms.

To generate a harmonious sound, it is generally necessary to control the frequency contribution of the vibration generated when the gong is struck. Optimization of the conditions of impact of the hammer on the gong is insufficient to select the desired frequency composition and thus harmonic tuning. In particular, this does not increase the purity of the sound produced.

SUMMARY OF THE INVENTION

It is thus an object of the invention to overcome the drawbacks of the state of the art by providing a striking mechanism, particularly for a watch, which is capable of selecting a particular mode of vibration of at least one gong struck by a hammer, which is simple to produce.

The invention therefore concerns an aforecited striking mechanism, which includes at least one gong fixed to a gong-carrier, at least one hammer for striking the gong at predetermined times, and a means of selecting at least one mode of vibration of the gong, characterized in that the movable or fixed selection means includes at least one selector element arranged in contact on one part of the gong and held on a vibration node of one of the modes of vibration of the gong so as to remove completely or partially the other modes of vibration.

One advantage of the striking mechanism according to the present invention is that it provides an original sound when the gong is struck owing to the position of at least one selector element on a node of a mode of vibration of at least one gong. Actuation of this mode is facilitated by said selector. This type of sound can thus have an easily identifiable dominant note. This type of mode of vibration selector has the additional advantage of considerably limiting unwanted vibrations of the gong in the event of accidental micro-shocks. It therefore removes unwanted noise.

Another advantage of the striking mechanism according to the present invention is that there is a better use of energy. The low frequency modes of vibration can be blocked by the selector element and thus do not use energy.

Another advantage of the striking mechanism of the present invention is that it is also possible to create various notes with several selector elements arranged on one gong. This permits a note to be selected by the use and differentiation of sound for example between midnight and midday and between midday and midnight. Moreover, the mode of vibration selection means may be achieved at low cost or conversely, if required, it may be made of precious materials. This thus actively contributes to the aesthetic value and preciousness of the watch.

Advantageously, the movement of the selector element on one or more gongs can be achieved mechanically via a rack arrangement or magnetically via an arrangement of magnetic components between the selector element and a means of moving the striking mechanism.

BRIEF DESCRIPTION OF THE DRAWINGS

The objects, advantages and features of the watch striking mechanism will appear more clearly in the following description, particularly with reference to the drawings, in which.

DETAILED DESCRIPTION OF THE INVENTION

In the following description, all the parts of the watch striking mechanism that are well known in this technical field will be only briefly described. Reference will be made exclusively to the means of selecting at least one mode of vibration of one gong or several gongs without mentioning in detail the hammer or hammers and the arrangement thereof in the mechanism for striking the gong(s).

Figure 1:
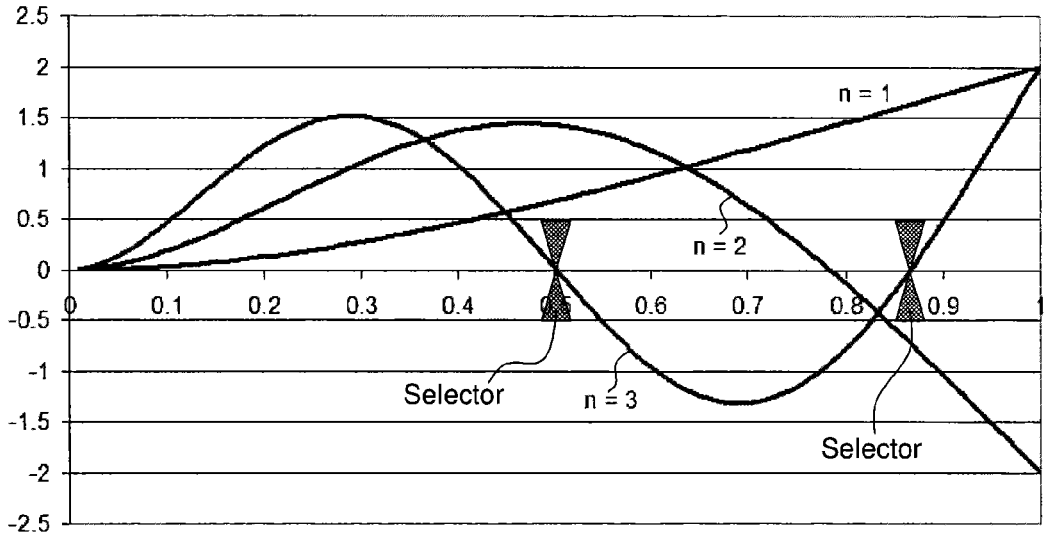
FIG. 1 shows a simplified graph of the deflected curve of a gong fixed at one end with various modes of vibration following the impact of a hammer and the location of the mode of vibration selector elements.

FIG. 1 shows a graph of the deflected curve of a gong of length L, which is fixed, for example at one end thereof, to a gong-carrier fixed to an internal watch part, for example to a plate. FIG. 1 shows various modes of vibration of the gong following the impact of a hammer. Without the mode of vibration selection means, the gong is liable to vibrate with a combination of a first mode of vibration indicated by n=1, a second mode of vibration indicated by n=2 and a third mode of vibration indicated by n=3. Several other modes of vibration may also be combined with the first three modes of vibration, but are not shown to avoid overloading said Figure.

The FIG. 1 graph is, for example, defined for a gong having a diameter of less than 1 mm, for example 0.6 mm, and a length of around 90 mm. The gong of this example is fixed at one end thereof to a gong-carrier as shown in the graph at the origin of the x axis. The gong material may be chosen to be steel or gold or metallic glass, i.e. metal or amorphous metal alloy. This metallic glass may, for example, be made from a base of zirconium, gold, platinum, or gold with palladium, platinum and silver or any other metal capable of solidifying in amorphous form.

The striking mechanism thus includes a means of selecting at least one mode of vibration of the gong. This selection means includes at least one selector element or two selector elements as symbolically represented in FIG. 1. A means of moving and positioning the selector element or elements may also be provided. These selector elements are arranged at the location of the vibration nodes of the third mode of vibration, i.e. these selector elements may clamp the vibration nodes of the third mode. In these conditions, all the other modes of vibration are pushed to a higher frequency and thus greatly removed by these selector elements. The gong thus mainly vibrates in what would be its third mode of vibration if the selector element were absent.

Of course, the removal of lower frequency modes, particularly what would be the fundamental mode with no nodes in the absence of the selector element, may also be achieved by a single selector element arranged on the first vibration node of the third mode of vibration. Another mode of vibration with a higher or lower frequency than that of the third mode may also be selected by one or more selector elements arranged differently. In the embodiments discussed below, reference is therefore made only to one vibration mode selection element, but several selector elements may also be provided for each gong as mentioned in FIG. 1.

It is also to be noted that the striking mechanism of the invention is characterized by the presence of at least one mode selector element, of at least one gong having fixed-free, fixed-supported or fixed-fixed edge conditions. A mode selector element is physically defined as a fixed or movable component allowing the gong to achieve a condition of simple mechanical support in a position corresponding to a node of one of the fixed-free, fixed-supported or fixed-fixed free modes. Mathematically, a mode selector element positioned in correspondence with position X0 on the main axis of the gong, which is oriented in direction x, is defined by the following simple conditions of mechanical support:

$$w(X0,t)=0 \tag{1}$$

$$(w'(x,t)|_{x=x0})\neq 0 \tag{2}$$

w(x, t) being the movement of the gong in one of the two directions orthogonal to the axis of the gong, w'(x, t) being the first mathematical derivative of the movement as a function of coordinate x and t being time. Condition (1) requires the gong not to be movable in correspondence with the selector element, while condition (2) guarantees that the axis of gong can be inclined relative to the rest position thereof in correspondence with the selector element.

The introduction of a mode selector element modifies the frequency and modal shape of all the gong modes, except those of the selected mode, having a node in correspondence with the selector element position and thus allowing conditions (1) and (2) to be observed.

Figures 2, 3A:
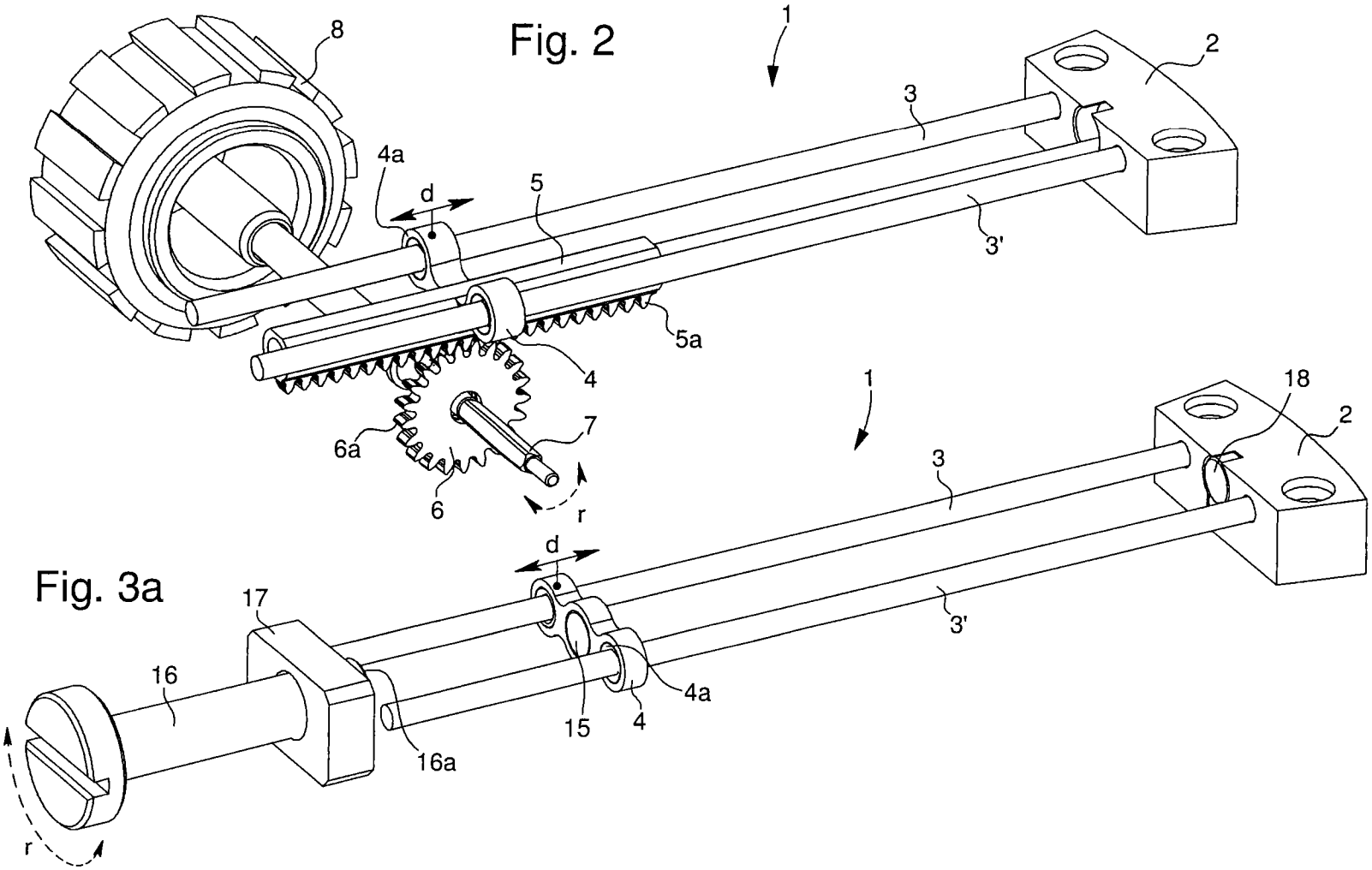
FIG. 2 shows a simplified three-dimensional view of a first embodiment of the striking mechanism with means of selecting the mode of vibration of one or two gongs according to the invention.
FIGS. 3*a* and 3*b* show a simplified three-dimensional view and a simplified top view of a second embodiment of the striking mechanism with a magnetic means of selecting the mode of vibration of one or two gongs according to the invention.

FIG. 2 shows a first embodiment of striking mechanism 1 with a means of selecting at least one mode of vibration of at least one gong. In this first embodiment, two gongs 3, 3' of rectilinear shape are provided, each fixed at one end thereof to the same gong-carrier 2. The two gongs 3, 3' are thus arranged in parallel in relation to each other. The length and cross-section of the two gongs may preferably be identical or different according to the note to be radiated when one or other of the hammers strikes. Gong-carrier 2, and the rotating hammer or hammers (not shown), are generally mounted on a watch plate (not shown).

The vibration mode selection means of striking mechanism 1 first of all includes a selector element 4 arranged on gongs 3, 3'. Selector element 4 may be arranged at a location on the gongs corresponding to a node of one of the gong vibration modes to be selected so as to remove the unwanted vibration modes of one vibrating gong or the other. This selector element 4 may thus be moved along the length of gongs 3, 3' to occupy a defined position according to the vibration mode to be selected by a movement or positioning means. Preferably, this selector element 4 is formed of two rings joined by a central piece. The two parallel rings may have the same internal diameter, which is close to or slightly greater than the diameter of the cross-section of each gong. The distance between the centres of the two rings is identical to the distance between the centres of the two gongs. The two rings are initially introduced or inserted from a free end of each gong to enable selector element 4 to slide over the length of gongs 3, 3'.

The inner parts 4*a* of the two rings of selector element 4 which come into contact with the external surface of each gong may be formed with olive jewel holes. This facilitates the sliding of the selector element on the gong or gongs 3, 3' and also generates a point of contact or a line of contact on each gong for selecting the desired mode of vibration. Instead of olive jewel-holes, micro-balls may also be used. These micro-balls guarantee isolated contacts and allow locking in translation in the direction orthogonal to the gong axis in correspondence with the vibration node (relation 1) without locking in rotation (relation 2).

The vibration mode selection means further includes a wheel 6, whose periphery may come into contact with a rectilinear extension 5 of the central piece of selector element 4. The axis of rotation 7 of wheel 6 is preferably arranged perpendicular to gongs 3, 3' so that wheel 6 in rotation r drives selector element 4 via its rectilinear extension 5 in a direction d over the length of gongs 3, 3'. The rectilinear extension 5 extends in parallel between the two gongs 3, 3' and the length thereof, in cooperation with wheel 6, enables selector element 4 to be moved on at least one position of the gongs relative to the vibration mode selection of the gongs.

In the first embodiment of striking mechanism 1, wheel 6 is a wheel with teeth 6*a*, whereas extension 5 includes a series of teeth 5*a* in the length direction of the extension, which can mesh with the teeth of the toothed wheel. In this manner, extension 5 can be moved in the direction d of the two gongs 3, 3' by a rack arrangement. Wheel 6 is driven in rotation r by a winding stem 7, which ends towards the exterior of the watch case in a crown 8. This crown 8 can normally be pulled out or pushed in from the exterior of the watch case in order to rotate wheel 6 and to position selector element 4 on gongs 3, 3'.

It is to be noted that selector element 4 may also have a different shape from that mentioned above. A selector element 4 may be of parallelepiped shape with two through apertures of equal or slightly greater diameter than the diameter of the cross-section of each gong. The distance between the centres of the two apertures is identical to the distance between the centres of the two gongs to allow the selector element to slide over the gongs. The two apertures may thus be fitted with olive jewel holes to ensure a contact on the external surface of each gong.

A push button may be provided for moving the selector element using the rack arrangement and the winding stem. This push button may be connected to an actuating stem to allow the selector element to be positioned at the desired location on the gong or gongs each time the button is pressed. It is thereby possible to modify the chimes on demand or to generate a different sound for day or night for the watch with striking mechanism 1.

A selector element 4 may also be arranged in the form of a single ring or a unit of parallelepiped shape with a through aperture to bear on a single gong. The aperture in the ring or unit may be different from circular shape, for example rectangular or hexagonal depending on the cross-section of the gong. A rectilinear extension may be arranged on the external portion of the ring or of the unit and arranged parallel to the length of the gong. Selector element 4 may be driven by wheel 6 via the extension to move along the gong. The extension may include a series of teeth meshing with the teeth of the toothed wheel. Wheel 6 may be driven by a gear arrangement, actuated by the mainspring of the watch until the selector element position reaches the desired mode of vibration. Two selector elements may also be arranged to slide independently of each other on each respective gong, in order to select the same mode of vibration or two different modes of vibration.

Figure 3B:
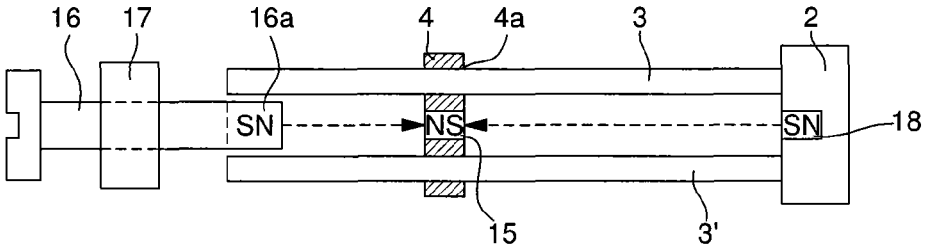

FIGS. 3*a* and 3*b* show a second embodiment of striking mechanism 1 with a magnetic means of selecting at least one mode of vibration of one or more gongs. It should be noted that those elements in FIGS. 3*a* and 3*b* that are the same as those in FIG. 2 bear identical reference signs. Consequently, for the sake of simplification, these elements will not all be described in detail. In this second embodiment, two gongs 3, 3' of rectilinear shape are therefore provided, each fixed at one end thereof to the same gong-carrier 2.

This second embodiment differs from the first embodiment in that magnetic components are used for moving selector element 4 on the gong or gongs 3, 3'. In this second embodiment, it is preferable for the gongs to be designed in a non ferromagnetic material, for example gold or metallic glass, so as not to affect the movement of the selector element. Selector element 4 is shown in the form of two rings joined by a central piece. As in the first embodiment, the two rings which may or may not be provided with olive jewel holes, allow selector element 4 to slide on the gong or gongs 3, 3'. A magnetic element, which may be a permanent magnet 15, is arranged in the central piece of the selector element or is made in the material of the central piece. The North-South direction of magnetic polarisation of magnet 15 is in the length direction of the gong or gongs.

The selection means further includes a screw 16 having an end part 16*a* which is magnetised or provided with a first permanent magnet 16*a* at the end of the screw opposite the screw head. The direction of magnetic polarisation of the end part of the screw is in the length direction of gongs 3, 3', but of opposite polarisation to that of magnet 15 of selector element 4. The screw 16 passes into a threaded support 17. The support may also be fixedly mounted on the watch plate. The longitudinal axis of the screw is arranged parallel to the gongs. The rotation r of screw 16 in the thread of support 17 moves the magnetised part 16*a* of screw 16 towards selector element 4 or in the opposite direction. When the magnetised part 16*a* of the screw moves closer to magnet 15 of the selector, this has the effect of repulsing the magnet as shown by the arrow in dotted lines in FIG. 3*b*, and of sliding selector element 4 on the gongs.

In order to hold the selector element in a determined position on gongs 3, 3' the vibration mode selection means further includes a second permanent magnet 18 arranged between the fixed ends of the two gongs 3, 3' to gong-carrier 2. The direction of magnetic polarisation of second permanent magnet 18 is also in the length direction of the gongs and is of opposite polarisation to that of magnet 15 of selector element 4. This second permanent magnet 18 repulses the selector element, like the first magnet 16*a* of the screw as shown by the arrows in dotted lines in FIG. 3*b*. Equilibrium is established when the repulsion force generated by the first permanent magnet 16*a* on selector element magnet 15 is equal to the repulsion force generated by the second permanent magnet 18 on magnet 15. Thus a determined position of selector element 4 can be achieved to select the mode of vibration of the vibrating gong or gongs.

Figure 4A:
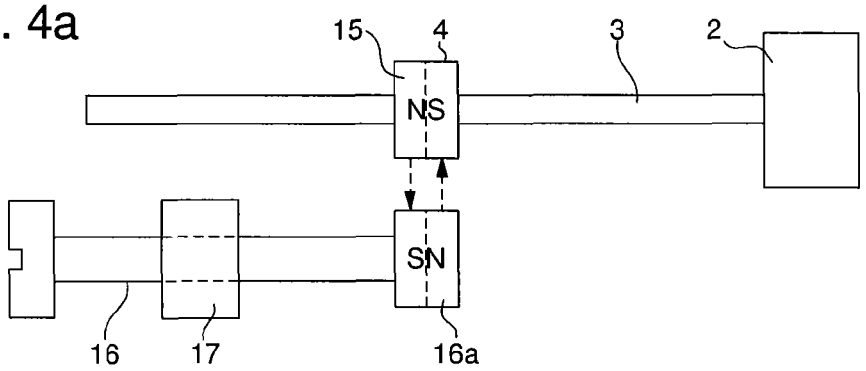
FIGS. 4*a* and 4*b* show simplified top views of a third embodiment of the striking mechanism with a magnetic means of selecting the mode of vibration of at least one gong according to the invention.
Figure 4B:
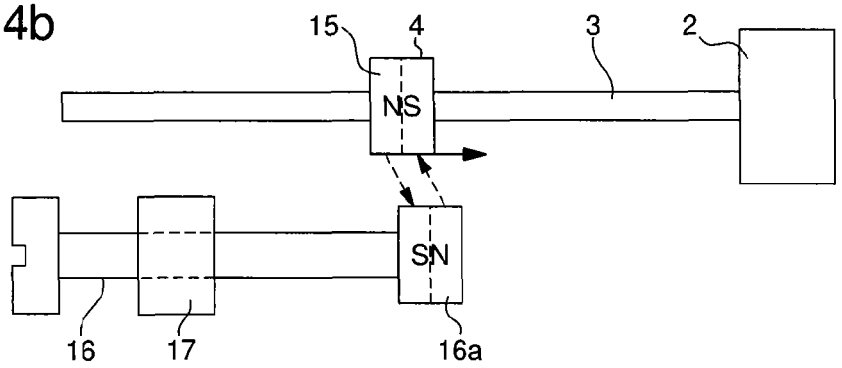

FIGS. 4*a* and 4*b* schematically show a third embodiment of striking mechanism 1 with a magnetic means of selecting at least one mode of vibration of at least one gong. It is to be noted that elements in FIGS. 4*a* and 4*b* which are the same as those in FIGS. 2, 3*a* and 3*b* bear identical reference signs. Consequently, for the sake of simplification, these elements will not all be described in detail.

The striking mechanism 1 of this third embodiment includes a single rectilinear gong 3, which is fixed at one end thereof to a gong-holder 2. A selector element 4 in the form of a ring or parallelepiped block with a through aperture is slidably mounted on gong 3. Selector element 4 includes a permanent magnet, which may be made directly in one part of the material of selector element 4 or be fixed to one part of the selector element. The North-South direction of magnetic polarisation of this magnet of selector element 4 is in the length direction of gong 3.

Striking mechanism 1 further includes, as selection means, a screw 16 having an end portion 16*a* which is magnetised or provided with a magnet 16*a* at the end of the screw opposite the screw head. This screw 16 passes into a threaded support 17, which may be mounted on the watch plate. The direction of magnetic polarisation of the magnetised end portion of the screw or of the magnet at the screw end is in the length direction of gong 3, but is of opposite magnetic polarity to that of the magnet of selector element 4. The screw is arranged in parallel to the gong with magnet 16*a* next to the selector element magnet and with no contact with the magnet of selector element 4.

In FIG. 4*a*, since magnet 16*a* of screw 16 is next to the selector element magnet with an opposite direction of magnetic polarisation, magnetic attraction occurs between the two magnets. In a rest position with no movement of selector element 4, the position of the selector element is well defined by interaction or magnetic attraction with magnet 16*a* of screw 16. The magnetic forces existing between the two magnets, combined with the elastic return force of the gong, eliminate the movements in translation of the magnet of selector element 4, i.e. movements in the length direction of gong 3, and in the direction perpendicular to gong 3. Conversely, the rotational movements of the gong are not eliminated, because they do not substantially modify the magnetic co-energy of the system formed by the two anti-parallel magnets. When the hammer strikes the gong, the selector element must be positioned on a node of vibration mode to be selected.

FIG. 4*b* shows a movement of magnet 16*a* of screw 16 following a rotation of said screw in support 17. In these conditions, there is an attraction force F on the magnet of selector element 4 imparting thereon a sliding motion over gong 3 so that the magnet moves next to magnet 16*a* of screw 16. At equilibrium, selector element 4 may be in a position corresponding to the selected mode of vibration.

It is to be noted that it is entirely possible to extend the principle of moving the selector element or elements via the arrangement of magnetic components to a circular gong (not shown). In these conditions, a magnet may be arranged on a disc centred relative to the centre of the circular shape of the gong. When the disc rotates with the magnet, the selector element and another magnet on the gong can be moved by the magnetic repulsion of the magnet on the disc.

It is also to be noted that selector element 4 of one or other of the embodiments presented above may be in the form of a clamp, as the selection means. This clamp can thus fixedly sandwich the gong or gongs 3, 3' on at least one node of the vibration mode of the gongs. This clamp type of selector element may be chosen instead of the contact attained with the olive jewel holes. The clamp selector element minimises the contact area between the gong or gongs and the vibration mode selector element. This selector element 4 may take the form of a flexible guide member, which is formed by two or more strips of micrometric thickness made of silicon, or silicon oxide or NiP, such as LIGA. Each of these strips is fixed in two supports, and deformed in bending to fixedly sandwich one or more gongs 3, 3' at at least one node of a mode of vibration of the gong or gongs. The contact width for a clamp of this type may be around 5 μm or less.

Instead of the olive jewel holes in selector element 4, two micro-magnets may be provided, arranged on either side of gong 3, which is made of ferromagnetic material or is coated with a ferromagnetic material such as nickel. In this manner, the plane defined by the two micro-magnets and the gong is orthogonal to the plane of vibration of the gong.

All the embodiments described above concern one or more gongs having one end fixed to a gong-carrier and the other end free to move. However, it is also possible to envisage having one or more gongs with both ends fixed to a first gong-carrier and to a second gong-carrier. It is also possible to envisage having one or more gongs with one end fixed to a gong-carrier and the other end supported on a support to define a simple support condition. The mode selector systems described here can be immediately applied to this different type of gong without any major modifications.

Instead of a selector element formed of olive jewel holes, one or more tubes with no support may be provided, sliding on the gong or gongs. These tubes eliminate the bending of the gong over a length of more than 50 μm. In these conditions, only the modes having a node in correspondence with the tubes are actuatable when the hammer strikes, since in correspondence with a node, the bending of the gong is minimal.

For this type of striking mechanism, two hammers can strike the gong. The first hammer may be positioned between the fixed fitting and the movable fitting of the selector element, whereas the second hammer is between the movable fitting and the free end of the gong. The advantage of this solution is that the hour and minute sound can be obtained from the strike of the same hammer.

From the description that has just been given, several variants of the striking mechanism provided with a means of selecting at least one mode of vibration of a gong or of several gongs can be devised by those skilled in the art without departing from the scope of the invention defined by the claims. All the solutions described can be applied without any major modification to the case of one or more gongs having a non-homogeneous cross-section. One or more gongs having two materials or with an external coating may also be used without any major modification.

The invention claimed is:

1. A striking mechanism, comprising:

at least one gong fixed to a gong-carrier;

at least one hammer for striking the gong at predetermined times; and a means of selecting at least one mode of vibration of the gong, wherein the selection means is movably mounted on the gong and includes at least one selector element arranged in contact on one part of the gong and held on a vibration node of one of the modes of vibration of the gong so as to remove completely or partially the other modes of vibration.

2. The striking mechanism according to claim 1, wherein the selector element is capable of being moved on the gong by a means of moving the selection means to position said element on a vibration node of a mode of vibration of the gong to be selected.

3. The striking mechanism according to claim 1, wherein the selector element includes a through aperture allowing said element to be arranged and to slide on the gong.

4. The striking mechanism according to claim 3, wherein the aperture or the apertures of the selector element include olive jewel holes or micro-balls to come into isolated or lineic contact with the gong or gongs, on which the selector element is mounted.

5. The striking mechanism according to claim 1, wherein the selector element is slidably mounted on the gong, wherein the selection means further includes a screw having an end portion which is magnetised or provided with a magnet at the opposite end of the screw to a screw head, and a fixed threaded support for receiving the screw, the screw having a longitudinal shaft arranged parallel to the gong, and capable of being moved in a length direction of the gong following a rotation of the screw in the threaded support, and a direction of magnetic polarisation of the magnetised end portion of the screw or of the first magnet being in the length direction of the gong, and wherein the selector element includes a selector permanent magnet of opposite magnetic polarisation to that of the magnetised end portion of the screw or of the permanent magnet of the screw in the length direction of the gong so as to be situated, via an attraction force, next to the magnetised end portion of the screw or of the permanent magnet of the screw, a rotational movement of the screw in the threaded support allowing the selector element to be positioned on a vibration node of a mode of vibration to be selected.

6. The striking mechanism according to claim 1, wherein the selector element includes an extension on an external portion of the selector element, which is parallel to the gong, and wherein the selection means includes a wheel in contact with the extension and rotatably mounted about an axis of rotation in the striking mechanism so as to move the selector element on the gong and to hold the selector element on a vibration node of a mode of vibration of the gong to be selected.

7. The striking mechanism according to claim 6, wherein the extension of the selector element includes a series of teeth for meshing with teeth of the wheel.

8. The striking mechanism according to claim 6, wherein the gong is rectilinear and parallel to the extension of the selector element, and wherein the axis of rotation of the wheel is arranged perpendicular to a length of the gong.

9. The striking mechanism according to claim 1, wherein the striking mechanism includes two parallel gongs fixed at one end to the gong-carrier, and wherein the selector element includes two through apertures allowing said element to be arranged and to slide on the two gongs.

10. The striking mechanism according to claim 9, wherein the two gongs are rectilinear, and wherein the selector element includes two rings joined by a central piece.

11. The striking mechanism according to claim 10, wherein the two rings have an internal diameter equal to or greater than the diameter of a cross-section of each gong.

12. The striking mechanism according to claim 10, wherein the selector element includes a rectilinear extension on the central piece, which is parallel to the gongs, and wherein the selection means includes a wheel in contact with the rectilinear extension and rotatably mounted about an axis of rotation in the striking mechanism so as to move the selector element on the gongs and hold the selector element on a vibration node of a mode of vibration of the gongs to be selected.

13. The striking mechanism according to claim 12, wherein the extension of the selector element includes a series of teeth for meshing with teeth of the wheel.

14. The striking mechanism according to claim 12, wherein the striking mechanism is arranged to be mounted in a watch case, wherein the wheel is arranged to be driven in rotation by a winding stem having a drive crown.

15. The striking mechanism according to claim 9, wherein the selection means includes a screw having a end portion which is magnetised or provided with a first magnet at the opposite end of the screw to a screw head, and a fixed threaded support for receiving the screw, the screw having a longitudinal axis arranged parallel to the gongs, and capable of being moved between the two gongs following a rotation of the screw in the threaded support, and a direction of magnetic polarisation of the magnetised end portion of the screw or of the first magnet being in a length direction of the gongs, wherein the gong-carrier includes a second permanent magnet of identical magnetic polarisation to that of the magnetised end portion or of the first magnet of the screw, and wherein the selector element includes between the two apertures a selector permanent magnet arranged between the magnetised end portion or the first magnet of the screw, and the second permanent magnet, and having opposite magnetic polarisation to the first and second magnets, the selector element being positioned and held on the gongs by a repulsion force of the first magnet identical to a repulsion force of the second magnet.

16. The striking mechanism according to claim 9, wherein the aperture or the apertures of the selector element include olive jewel holes or micro-balls to come into isolated or lineic contact with the gong or gongs, on which the selector element is mounted.

* * * * *